US005141106A

United States Patent [19]

Adams et al.

[11] Patent Number: 5,141,106

[45] Date of Patent: Aug. 25, 1992

[54] TWO SEPARATE CARTONS COMBINED AS A SINGLE UNIT BY ADHESIVE/CARRIER MEANS

[75] Inventors: John M. Adams, Mechanicsville; Christopher N. Chance, Richmond; James A. DeBlasio, Midlothian; Donald H. Evers, Richmond; William C. Harris, Jr., Midlothian; Michael A. Kirby, Sr., Trevilians; Reginald W. Newsome, Richmond; Robert E. Talley, Chester; William P. Taylor, Midlothian; Edward J. Woolridge, Richmond, all of Va.

[73] Assignee: Philip Morris Inc., New York, N.Y.

[21] Appl. No.: 774,529

[22] Filed: Oct. 8, 1991

[51] Int. Cl.[5] ..... B65D 85/10

[52] U.S. Cl. ..... 206/256; 206/273; 206/813; 206/459.5; 229/120.11

[58] Field of Search ..... 229/120.01, 120.04, 229/120.011, 120.09; 206/813, 264, 273, 271, 256

[56] References Cited

U.S. PATENT DOCUMENTS

| | | | |
|---|---|---|---|
| 2,109,583 | 3/1938 | Bennett | 206/813 |
| 2,565,509 | 8/1951 | Marcin | 206/813 |
| 2,605,897 | 8/1952 | Rundle | 206/264 |
| 2,697,544 | 12/1954 | Moran | 229/120.04 |
| 2,871,080 | 1/1959 | Shelly | 229/120.01 X |
| 2,895,601 | 7/1959 | Krukonis | 206/256 X |
| 3,071,244 | 1/1963 | Doran | 206/273 |
| 3,082,929 | 3/1963 | Aquino et al. | 206/256 X |
| 3,086,650 | 4/1963 | Chapman et al. | 206/273 |
| 3,113,673 | 12/1963 | Stein | 206/65 |
| 3,144,190 | 8/1964 | Holt et al. | 229/27 |
| 3,163,351 | 12/1964 | Borgardt | 206/256 X |
| 3,447,733 | 6/1969 | Smith et al. | 206/491 |
| 3,503,568 | 3/1970 | Galley | 242/74 |
| 3,536,246 | 10/1970 | Rosen | 206/256 X |
| 3,596,758 | 8/1971 | Phillips, Jr. e al. | 206/256 X |
| 3,721,335 | 3/1973 | Grant | 206/256 X |
| 3,752,308 | 8/1973 | Begemann | 206/273 |
| 3,759,379 | 9/1973 | Werth | 206/429 |
| 3,809,227 | 5/1974 | Begemann | 206/264 |
| 4,424,658 | 1/1984 | Focke | 53/398 |
| 4,441,611 | 4/1984 | Sommarvia | 206/431 |
| 4,485,926 | 12/1984 | Lenzmeier | 206/602 |
| 4,631,900 | 12/1986 | Mattei et al. | 53/448 |
| 4,669,611 | 6/1987 | Flaherty | 206/442 |
| 4,738,359 | 4/1988 | Phillips, Jr. | 206/256 |
| 4,928,817 | 5/1990 | Focke | 206/256 |
| 4,932,534 | 6/1990 | Focke et al. | 206/602 |

FOREIGN PATENT DOCUMENTS 358560 10/1931 United Kingdom .

*Primary Examiner*—William I. Price

*Attorney, Agent, or Firm*—Jeffrey H. Ingerman; Karen G. Horowitz

[57] ABSTRACT

A dual cigarette carton is formed from two identical single cartons. The two cartons are connected together with adhesive bearing carrier means such that the two cartons remain securely connected when in the dual configuration and can hence be processed for tax-stamping through standard machinery and distributed to the consumer as a dual unit. The use of adhesive bearing carrier means such as stickers allows for convenient and acceptable methods of separation of the dual carton for individual purchase of the single cartons.

56 Claims, 5 Drawing Sheets

FIG. 4
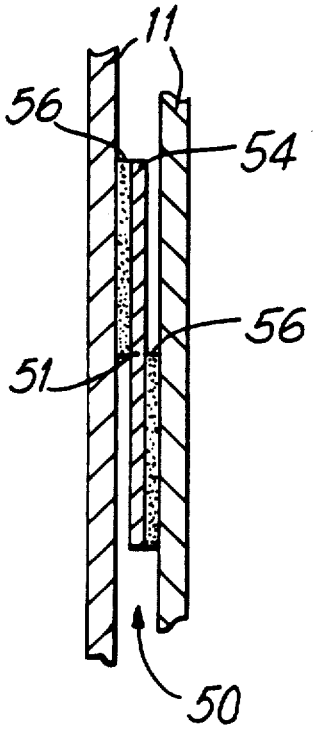
FIG. 5
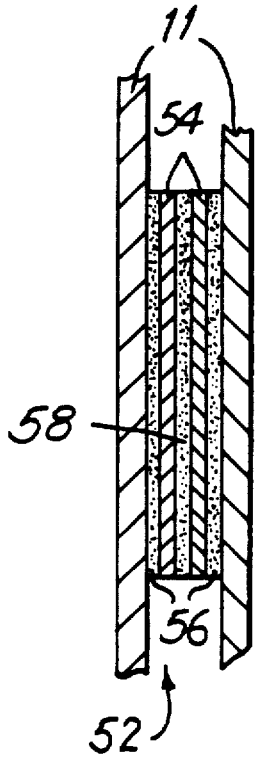
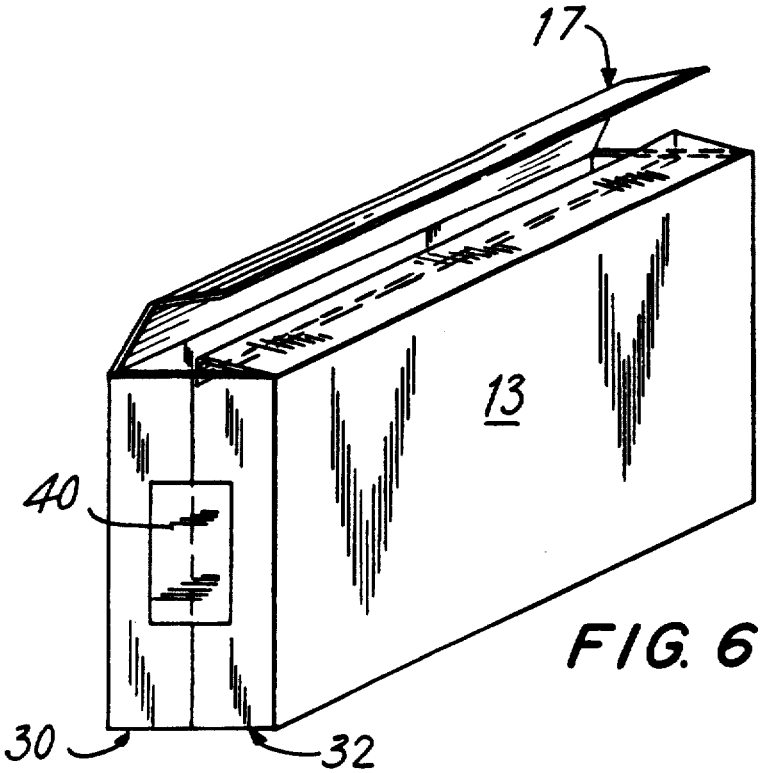
FIG. 6

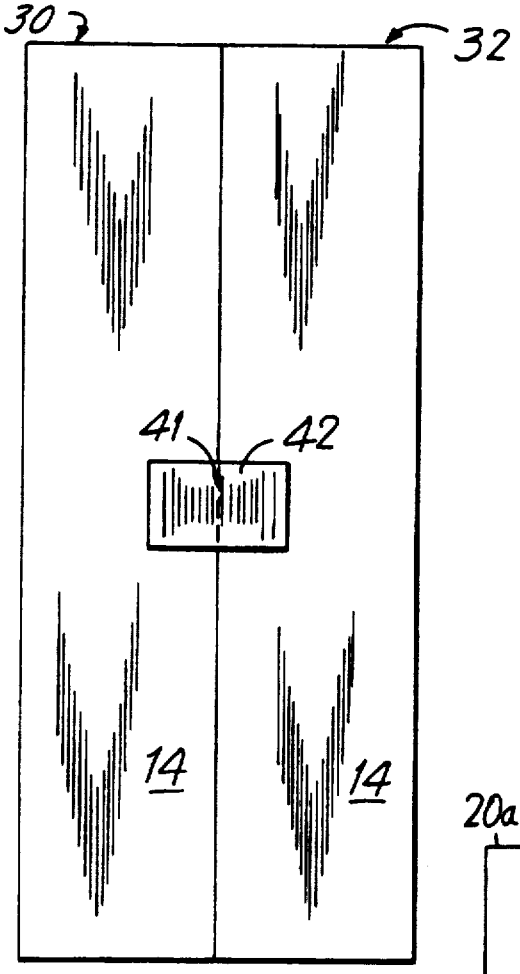
FIG. 7
FIG. 8
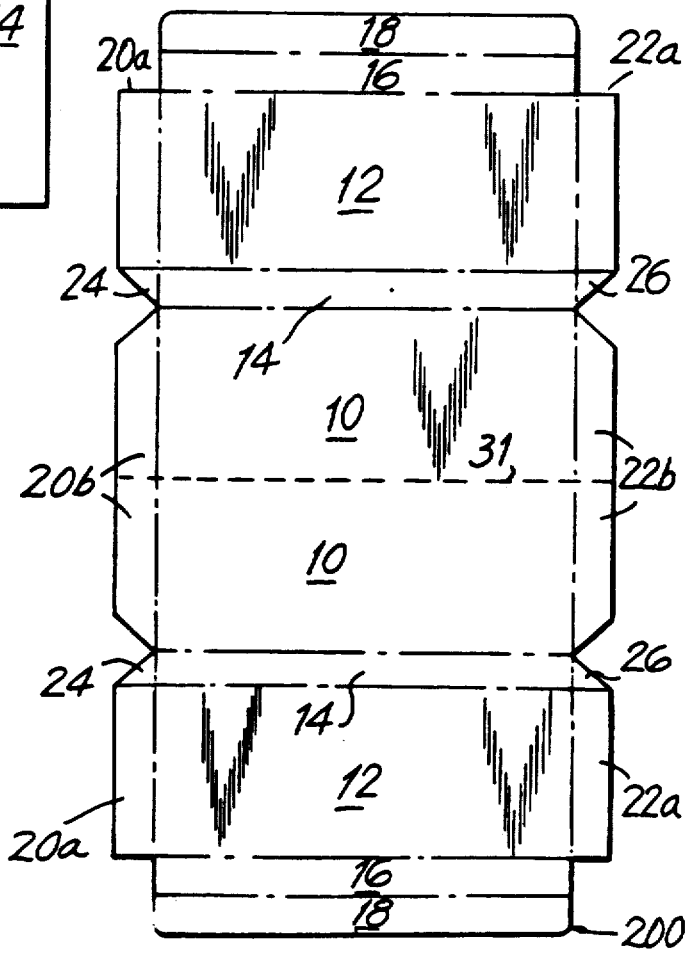

TWO SEPARATE CARTONS COMBINED AS A SINGLE UNIT BY ADHESIVE/CARRIER MEANS

BACKGROUND OF THE INVENTION

The present invention relates to cigarette cartons, and more particularly to the connection of two separate cigarette cartons to form a dual carton.

Cigarette packs (which usually contain twenty cigarettes) are generally rectangular in shape, having front and back long walls connected by two short side walls. Cigarette cartons typically contain two rows of five cigarette packs per row (each row arranged so that the front long walls of the packs are in the same plane and the back long walls are in a parallel plane spaced from the front long walls) and are generally known in the art as ten-pack cartons. Such cigarette cartons are generally filled with cigarette packs by the manufacturer, temporarily closed (e.g., by folding the top flap of the carton over the box and releasably securing the flap in the closed position), and shipped to various distributors. The distributors generally open the cartons to apply the tax stamp that may be required by the jurisdiction in which they operate to the ends of individual cigarette packs while still inside the cartons. Such procedures are commonly automated, to reduce time, cost, and labor, through the use of specially designed machines for applying tax stamps. Tax-stamping machines have been developed to open the cartons, apply the stamps, and finally seal the cartons for distribution. Such machines are generally commercially available, and are well known in the art. These machines have been developed for standard ten-pack cigarette cartons. A typical tax-stamping machine is model FUSON manufactured by Meyercord of 365 East North Avenue, Carol Stream, Ill. 60187.

Single row cigarette cartons which are dimensioned to contain one row of five cigarette packs (each pack usually containing twenty cigarettes, the packs arranged so that the front long walls of the packs are in the same plane and the back long walls are in a parallel plane spaced from the front long walls), i.e., five-pack cartons, are also known in the art. However, although machinery exists for manufacturing such cartons, machinery does not exist for stamping the cigarette packs contained in such cartons. Consequently, such single row cartons must either be hand-stamped (as is done currently) or would have to be secured together in pairs in order to be run through the existent tax-stamping equipment in which double row cartons are stamped. To assure that the tax stamp is properly registered, the means for securing the cartons must be strong enough to keep the cartons together such that they are not sheared apart by the vertical rollers of the tax-stamping machines which roll along the vertical walls of the cartons to transfer the cartons between the various stages of the process.

If two single row cartons are to be secured together, the means for securement must allow for later separation of the cartons, if desired, by the retailer or consumer. For marketing purposes, once separated, the two cartons should have little or no trace of the means for securement which would disfigure the outward appearance of the cartons.

SUMMARY OF THE INVENTION

It is therefore an object of this invention to provide for the capability of manufacturing and distributing cartons narrower than those processed by existent tax-stamping machinery common to distributors, without requiring customized tax-stamping machinery or hand stamping of the packs.

It is a further object of this invention to provide a means for securing together two narrow cartons to form a dual carton such that the two narrow cartons do not move relative to one another while being transferred through tax-stamping machinery designed to process cigarette cartons having the dimensions of the dual carton.

It is still another object of this invention to provide a means for making a clean separation between the two narrow cartons if desired for sale as individual cartons instead of as a dual carton composed of two narrow cartons.

These and other objects of the invention are accomplished in accordance with the principles of the invention by providing at least one carrier means bearing adhesive to securely connect two narrow cartons, such as five-pack cartons, together to have the final combined dimensions of a dual carton, such as a ten-pack carton, which may be passed through standard tax-stamping machinery. Such carrier means should allow for the separation of the two narrow cartons, if desired, for individual sale, without leaving unsightly residue which may negatively effect marketability.

BRIEF DESCRIPTION OF THE DRAWINGS

Further features of the invention, its nature, and various advantages will be more apparent from the accompanying drawings and the following detailed description of the preferred embodiments wherein like reference characters represent like elements throughout, and in which:

FIG. 4 is an enlarged partial side view in cross section of two five-pack cartons connected with an illustrative carrier means bearing adhesive affixed between the internal sides of the cartons, i.e., between the cartons and not readily visible;

FIG. 5 is an enlarged partial side view in cross section of two five-pack cartons connected with two illustrative carrier means bearing adhesive, affixed in a similar fashion as shown in FIG. 4;

FIG. 6 is an isometric view of two five-pack cartons after tax-stamping, connected with at least one carrier means bearing adhesive;

FIG. 7 is a bottom plan view of two five-pack cartons connected with at least one carrier means bearing indicia for price coding;

FIG. 8 is a plan view of an illustrative carton blank for forming two five-pack cartons joined by a perforated line in accordance with this invention;

DETAILED DESCRIPTION OF THE INVENTION

Figure 1:
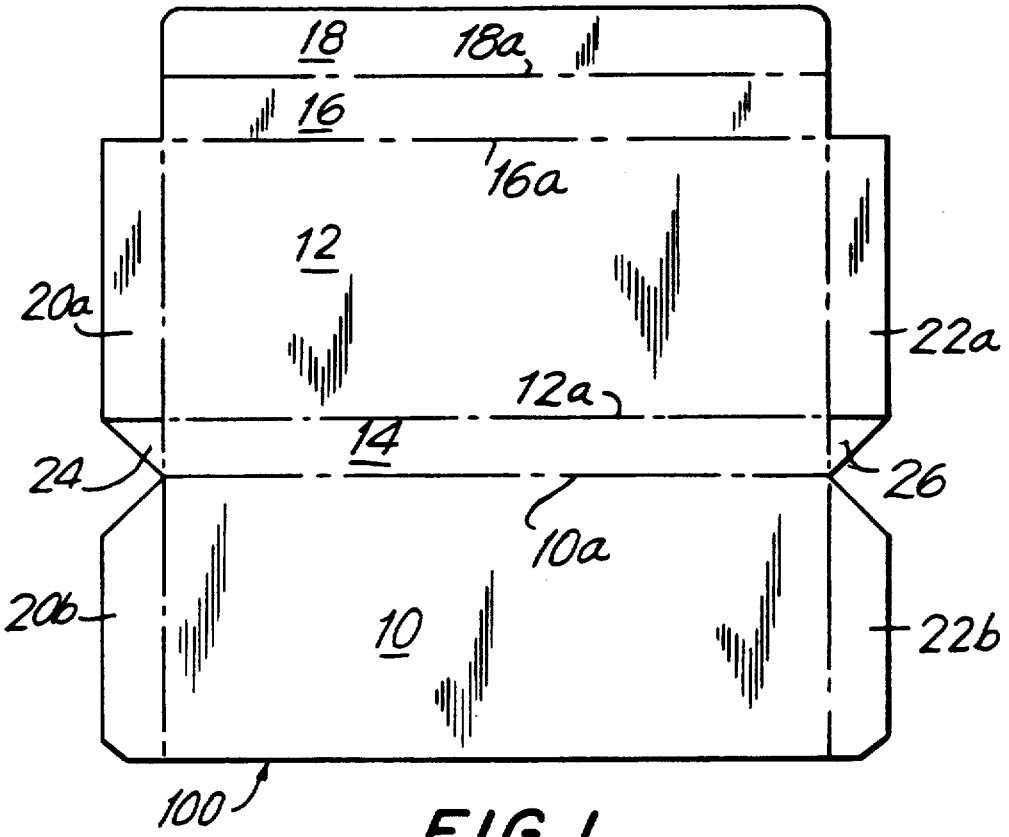
FIG. 1 is a plan view of an illustrative carton blank for a five-pack carton in accordance with this invention.

As shown in FIG. 1, blank 100, used for forming a carton adapted to hold one row of five cigarette packs, i.e., a five-pack carton, has a plurality of fold lines represented by broken lines. Blank 100 is preferably formed from a substantially rigid material such as paperboard. Each relatively large panel 10 and 12 of blank 100 is substantially five times the width of a long wall of a cigarette pack to be enclosed therein. As used herein, a standard cigarette pack is defined as any pack commonly used for holding a predetermined number of cigarettes, and generally having front and back long walls connected by two short side walls. When blank 100 is folded along respective fold lines 10*a* and 12*a*, panel 10 becomes the front wall of the carton and panel 12 becomes the rear wall of the carton. Joining panels 10 and 12 is a bottom panel 14, which forms the bottom wall of the carton when the blank is folded into a carton. Panel 16, having substantially the same dimensions as bottom panel 14, extends from rear panel 12. After walls 10 and 12 are assembled, panel 16 is folded along fold line 16*a* over the top of the carton to extend between walls 10 and 12 of the carton. Extension panel 18 joins panel 16 along a fold line 18*a*. Additional fold lines similar to fold lines 10*a*, 12*a*, 16*a* and 18*a*, are shown as broken lines located on blank 100 and on blank 200 (FIG. 8), but are not individually labeled.

Panels 16 and 18 together form a top and tuck-in flap 17. When the carton is formed and is ready for consumer purchase, extension panel 18 preferably lies substantially parallel to front wall 10, preferably inside the carton, and panel 16 is folded over the top of the carton towards front wall 10. Side panels 20*a* and 20*b* are folded one over the other to form a side wall 20 of the carton. Side panels 22*a* and 22*b* are folded in a similar fashion to form side wall 22. The "a" panel is preferably folded over the "b" panel. Tabs 24 and 26 are preferably folded perpendicular to panel 14 before the side panels are folded and will eventually lie substantially parallel to side walls 20 and 22, respectively. The distance between panels 10 and 12 of the completed carton is substantially the same as the distance between the front and back long walls of the enclosed cigarette packs.

Figure 2:
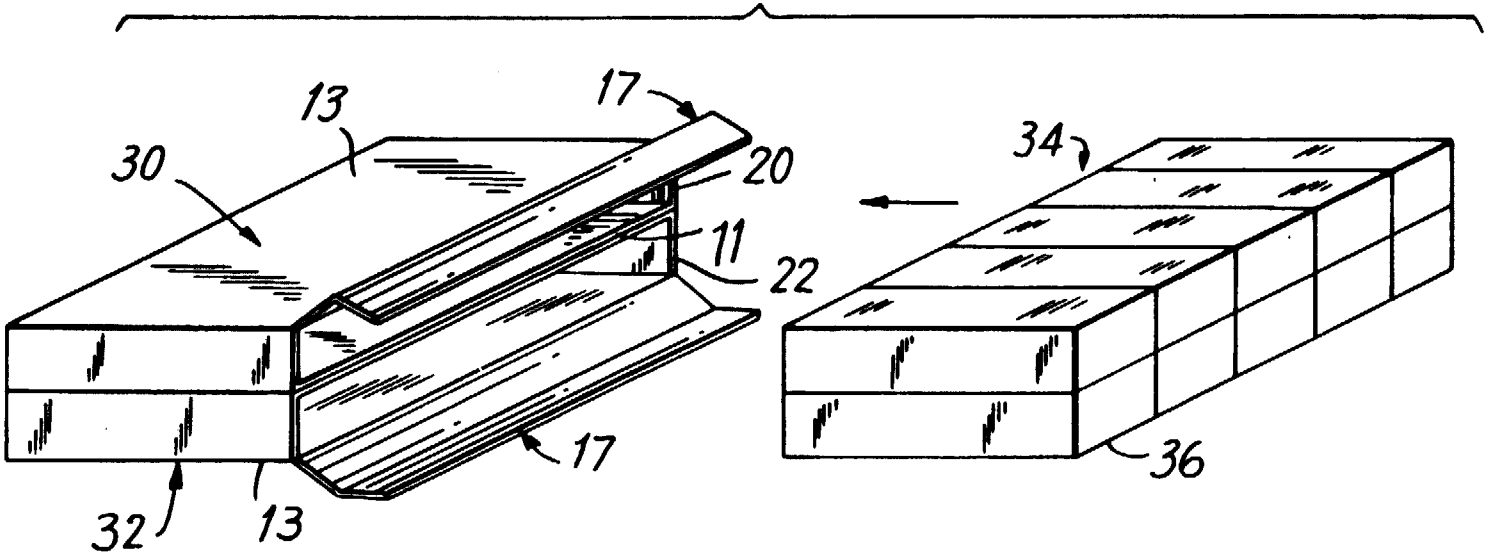
FIG. 2 is an exploded isometric view of two five-pack cartons, each constructed from a blank similar to that of FIG. 1, connected together in accordance with this invention to form, once connected a ten-pack carton, as illustrated prior to insertion of cigarette packs into the cartons.

FIG. 2 reveals two five-pack cartons 30, 32 connected along their front walls 10, hereinafter referred to as interior walls 11, and prepared for insertion of a bundle 34 of ten cigarette packs 36. Rear walls 12 remain visible after connection of cartons 30, 32, and are hereinafter referred to as exterior walls 13. Because the "a" panels of blank 100 are preferably folded over the "b" panels (panels 20*a*, 22*a*, 20*b*, and 22*b* shown in FIG. 1), the free edge of each of the "a" panels of the side walls faces inwardly, i.e., the free edges lie adjacent interior walls 11, when cartons 30, 32 are joined. In this configuration, the free edges of the "a" panels are not readily accessible and thus are relatively safe from being accidentally lifted from their place adjacent the "b" panels.

Packs 36 are preferably arranged in two rows of five packs per row with the short walls of adjacent packs facing each other and the long walls of the packs arranged in parallel planes such that the front walls of each row are in a first single plane and the rear walls of each row are in a second single plane spaced from and parallel to the first single plane. Furthermore, it is desirable to place packs 36 in their respective cartons such that their front walls (defined by the orientation of printed matter on the exterior surface of the walls) face interior walls 11 of cartons 30, 32. Flaps 17, which are formed from panels 16 and 18 of each blank 100 which forms cartons 30, 32, are shown opened in FIG. 2 such that the interiors of cartons 30, 32 are readily accessible for insertion of bundle 34.

Figure 9:
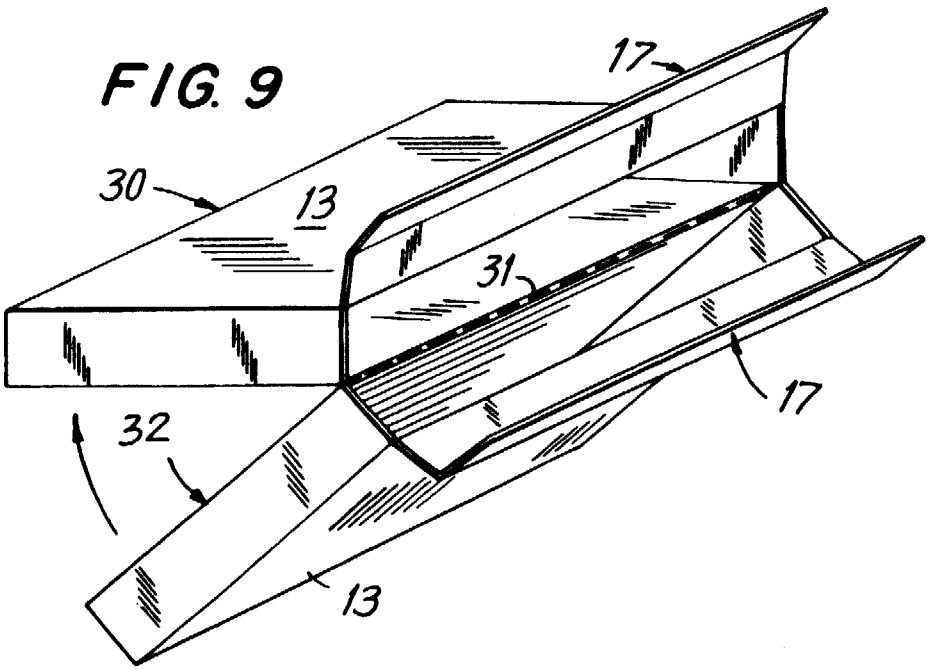
FIG. 9 is an isometric view of the final step in forming a ten-pack carton from two five-pack cartons constructed from the blank of FIG. 8.
Figure 10:
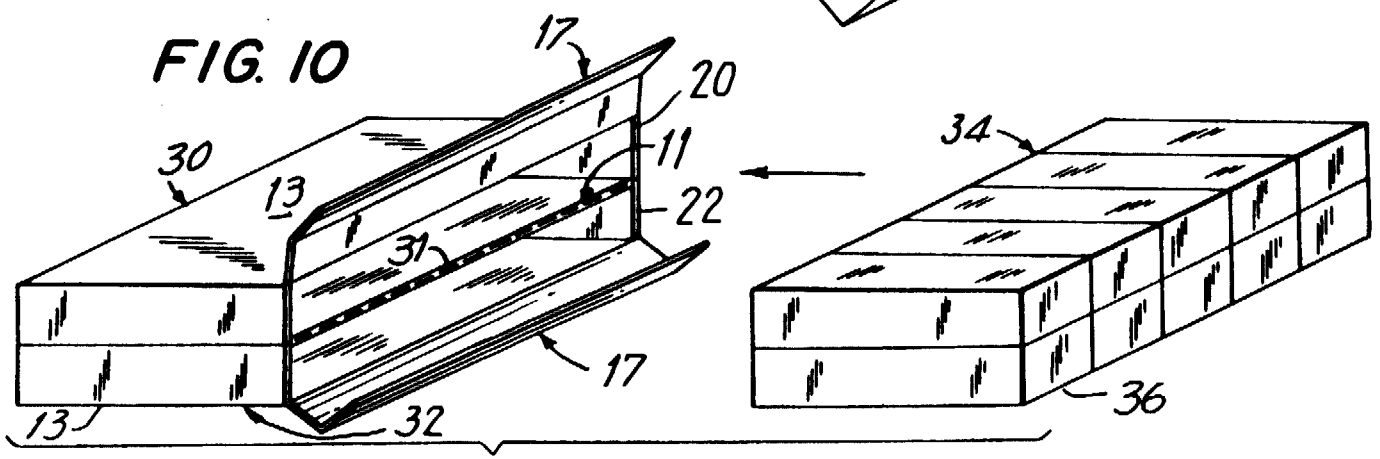
FIG. 10 is an exploded view similar to FIG. 2 but showing cartons constructed from the blank of FIG. 8.

As shown in FIG. 8, cartons 30, 32 may be formed from a single blank 200. Each half of blank 200 resembles blank 100, with like reference characters representing like elements, and broken lines representing fold lines. The substantially identical halves of blank 200 are connected by frangible means 31, i.e., a line of weakness such as a perforated line. Each half is individually folded to form a separate individual carton. Once each carton 30, 32 is formed, the blank is folded along line 31, as shown in FIG. 9, so that panels 10 lie against one another, facing each other as interior walls 11. The completed combined cartons may be seen in FIG. 10, which is similar to FIG. 2 (with like reference characters representing like elements) except the cartons are joined along a perforated line formed in the blank which forms both cartons.

Figure 3:
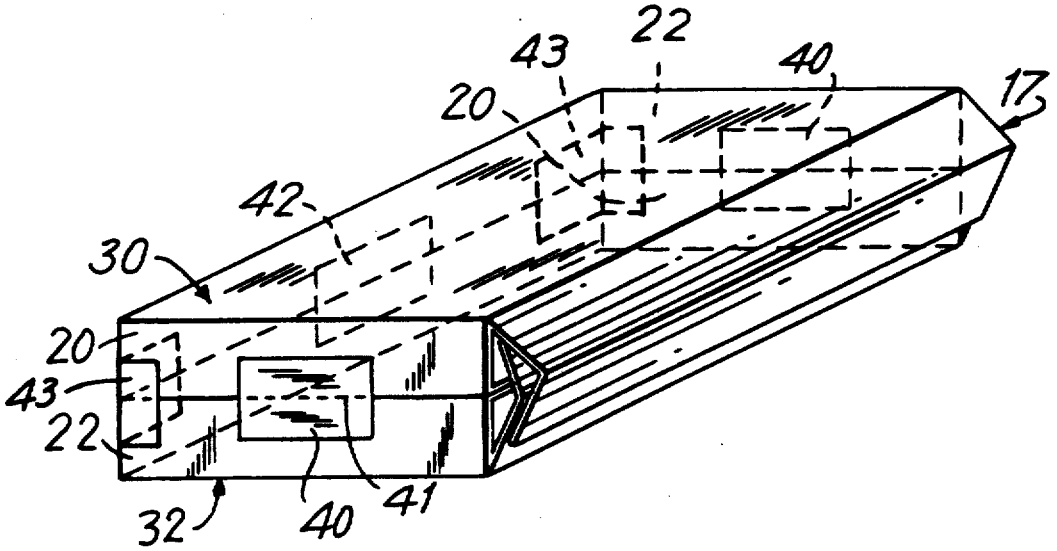
FIG. 3 is an isometric view of two five-pack cartons before tax-stamping, connected with at least one carrier means bearing adhesive affixed to the external sides of the cartons to thereby connect the cartons in accordance with this invention.

Illustrative carrier means bearing adhesive, hereinafter referred to as stickers 40, 42, and 43, are shown in FIG. 3. The carrier means of stickers 40, 42, and 43 are preferably mylar or paper, and bear either a permanent adhesive (any known permanent adhesive) or a releasable pressure-sensitive adhesive. Releasable, pressure-sensitive adhesive is herein defined as any adhesive known in the art which, preferably, is clear, has no taste or odor, and does not cause fiber pull of the carrier means or leave a tacky residue once the surfaces joined by the adhesive are separated (e.g., any adhesive known in the art which provides a strong bond between surfaces but once the surfaces are pulled apart, the bonds of the adhesive are broken and the adhesive is no longer tacky). The adhesive must be sufficiently strong to hold the cartons firmly in place relative to one another and resist such shearing force which would reasonably be applied through a difference in forces applied by vertical rollers of tax-stamping machines which roll along exterior walls 13 of the cartons during the tax-stamping process.

Stickers 40 are applied across side walls 20, 22 to maintain side walls 20, 22 in the same plane and adjacent one another. Either or both of stickers 40 may optionally have a frangible means 41, i.e., a line of weakness such as a perforated line, preferably positioned substantially parallel to the line defined by the intersection of the sticker and the plane which extends between and out from interior walls 11 (i.e., positioned between the two cartons) to facilitate a clean separation of the two cartons.

Sticker 42 is similarly applied across bottom walls 14 to likewise maintain bottom walls 14 in the same plane and adjacent one another. Sticker 42 may also have a frangible means (not shown) similar to frangible means 41.

Stickers 43 are applied partially across side walls 20, 22 and partially across bottom walls 14 to maintain side walls 20, 22 and bottom walls 14 in their respective planes and adjacent one another. Either or both of stickers 43 may optionally have a perforated line, preferably positioned substantially parallel to the line defined by the intersection of the sticker and the plane which extends between and out from interior walls 11.

Flaps 17 are shown in FIG. 3 as being lapped over one another in preparation to be shipped to a distributor and later opened, or, alternatively, in position for distribution to individual wholesalers or retailers for subsequent distribution to consumers. If desired, panel 18 of one of flaps 17 may be folded in and releasably secured under the panel 16 from which it extends to form a short top flap which is secured under the other, unfolded flap 17.

One of stickers 40, 42, or ,43 may optionally bear pricing indicia such as Universal Product Code (U.P.C.) or other pricing bar code, such as shown on sticker 42*a* in FIG. 7. Sticker 42*a* is placed along and across the bottom walls 14 of cartons 30, 32, with the lines of the pricing bar code being positioned substantially parallel to the adjacent edges of the walls 14 across which sticker 42*a* is placed. Preferably, frangible means 41 are included on sticker 42*a* positioned substantially parallel to the line defined by the intersection of the sticker and the plane between interior walls 11, and therefore substantially parallel to the lines of the bar code as well.

Similar pricing indicia (not shown) may be printed on the outer surface of the interior walls 11 of the cartons, such that the indicia are not visible when cartons 30, 32 are joined to form a dual carton. The readily visible indicia on sticker 42*a* are preferably coded for sale of the combined ten-pack dual carton and are rendered unreadable by automatic scanning equipment upon tearing sticker 42*a* to separate the two five-pack cartons 30, 32. The pricing indicia on interior walls 11 are preferably coded for sale of the individual five-pack cartons, and can be scanned only after separating the dual carton into individual cartons.

Carrier means bearing adhesive, hereinafter referred to as stickers 50, 52, are revealed in cross section in FIGS. 4 and 5. Sticker 50 has a single carrier means 54, preferably mylar or paper, with permanent adhesive 56 (any known permanent adhesive) applied to both sides of carrier means 54. Permanent adhesive 56 is preferably only applied to one half of each side of carrier means 54, at opposite ends of carrier means 54, such that at each point along the length of carrier means 54 there is adhesive on only one side of carrier means 54. Hence, when sticker 50 is positioned between cartons 30, 32, one half of sticker 50 adheres to interior wall 11 of carton 30 while the other half of sticker 50 adheres to interior wall 11 of carton 32. The cartons are separated by tearing carrier means 54 along the line where the adhesive halves meet. Carrier means 54 preferably has a frangible means 51, i.e., a line of weakness such as a perforated line, to facilitate such separation of cartons 30, 32. Interior walls 11 may be securely fastened to one another by one or more sticker means 50 during the tax-stamping process, but may be later separated from one another without much difficulty and without leaving behind any unsightly residue or frayed carrier means edges.

Sticker 52 is comprised of two carrier means 54, 54, preferably mylar or paper, set between interior walls 11, 11 of cartons 30, 32. The side of each carrier means 54 immediately facing an interior wall 11 carries permanent adhesive 56 (such as described above). The side of each carrier means 54 immediately facing an adjacent carrier means 54 carries releasable pressure-sensitive adhesive 58 (such as described above). Hence, both carrier means 54 are securely held onto their respective interior walls 11 by permanent adhesive 56 and are also securely connected to each other by pressure-sensitive adhesive 58 while undergoing the mechanized tax-stamping process. If separation of the two cartons 30, 32 is desired, carrier means 54 may be pulled apart along tack/non-tack releasable adhesive 58. Adhesive 58 is selected such that when the cartons 30, 32 are separated, the surface of carrier means 54 leaves no tacky residue. One or more sticker means 52 may be provided between interior walls 11 to connect cartons 30, 32.

Once connected cartons 30, 32 have undergone the mechanized tax-stamping process, the cartons are ready for shipment to a local retailer or wholesaler. As shown in FIG. 6, flaps 17 (which were open during the mechanical tax stamping process to provide access to packs 36 contained in cartons 30, 32 for tax stamp application by distributors) may now, optionally, be tucked into the individual cartons. Alternatively, the flaps can be lapped over each other, similar to lapping shown in FIG. 3, and secured flat across the tops of the cartons 30, 32.

Although each sticker is described as individually used, any combination of stickers may be used to achieve the desired secure connection between the two five-pack cartons 30, 32. Accordingly, stickers 50 and 52 may be used to connect interior walls 11, while stickers 40, 42 and 43 may be used for additional external connection of the cartons. Other combinations of stickers 40, 42, 43, 50, and 52 are also acceptable. Additionally, a transparent band of material, such as common to the art, may be wrapped around the cartons to further secure them together.

Although the stickers disclosed are represented as rectangular in shape, the stickers may be formed in any desirable shape, such as circular, triangular, square, etc. Furthermore, the size of the stickers disclosed may be any desirable size, within the dimensions of the walls on which the sticker is to be placed.

Although adhesives 56 and 58 are described as being permanent and releasable, respectively, it will be appreciated that adhesive 56 may alternatively be a releasable adhesive and adhesive 58 may alternatively be a permanent adhesive, both types of adhesive being known in the art.

It will be appreciated that sticker 42 (or, alternatively, sticker 40 or 43) may or may not bear U.P.C. or other pricing indicia (which preferably bear coding for sale of the dual carton). If such indicia are included, the sticker bearing such indicia may be used in combination with any or all of the disclosed stickers. Such indicia are situated such that the coding for ten-pack sale is rendered unreadable by automatic scanning equipment upon separation of cartons 30, 32. Furthermore, such indicia may be located on a sticker placed across any pair of adjacent coplanar walls as desired. Preferably only one sticker bearing pricing indicia is used.

Although flaps 17, designed to be tucked into cartons 30, 32, are shown, it will be appreciated that any appropriate flap may be used, such as a flap with panel 16 without extension 18, intended to be lapped over the top of the carton, but not tucked partially inside the carton.

Although extension panel 18 is described as tucked inside the carton, extension panel 18 may alternatively be secured to the outside of the carton.

Although cartons 30, 32 are described as each dimensioned to hold one row of five cigarette packs, they may be lengthened or shortened to hold more or fewer than five packs. Furthermore, it will be appreciated that these concepts may be applied to the connection of cartons of other configurations for which distributors commonly have tax-stamping machinery.

It will be appreciated that references to cigarette cartons and cigarette packs are not limited to only rectangular cartons and packs, but are intended to include all configurations which are available to consumers. Cigarette cartons include cartons with windows, cartons with rounded edges, and other configurations which are designed to be passed through tax-stamping equipment. Cigarette packs include such packs as oval packs, packs with rounded edges, and other non-rectangular shapes.

It will be appreciated that references to tax-stamping machinery are intended to include any existing equipment which is readily available to distributors, and modified versions.

It will be understood that the foregoing is merely illustrative of the principles of the invention, and that various modifications can be made by those skilled in the art without departing from the scope and spirit of the invention. The present embodiments are described for the purpose of illustration rather than limitation, and the present invention is limited only by the claims which follow.

What is claimed is:

1. A dual cigarette carton for packaging a first number of cigarette packs and of dimensions compatible with commercially available tax-stamping machinery used in the automated processing of cigarette cartons, each said cigarette pack having a pair of opposed long walls and a pair of opposed short walls, said dual cigarette carton comprising:

a first carton having four substantially vertical walls, an exterior top wall, and an exterior bottom wall; said four substantially vertical walls including an interior front wall, an exterior rear wall substantially parallel and spaced from said interior front wall, and first and second exterior side walls connecting juxtaposed vertical edges of said interior front wall and said exterior rear wall; wherein said exterior rear wall has an extension along the top edge thereof, said extension being folded substantially perpendicular to said exterior rear wall and extending towards said interior front wall, thereby forming said exterior top wall; the widths of said interior front wall and said exterior rear wall being sufficiently wider than a second number of times the width of the long wall of said cigarette pack, and the widths of said exterior side walls being sufficiently wider than a third number of times the width of the short wall of said cigarette pack such that a fourth number of cigarette packs, equal to the product of said second number of times the width of the long wall of said cigarette pack and said third number of times the width of the short wall of said cigarette pack, can be positioned inside said first carton with said short walls parallel said side walls;

a second carton substantially identical to said first carton, said first and second cartons positioned adjacent one another with the interior front wall of said first carton coextensive with the interior front wall of said second carton such that the borders of the interior front walls are aligned; and at least one substantially flat carrier means having a first side and a second side, and an adhesive borne on at least part of each side of said carrier means, said carrier means bearing said adhesive being positioned between said interior front walls of said first and second cartons with said adhesive in operative contact with said interior front walls to secure said cartons in position adjacent one another such that the borders of the interior front walls are aligned, wherein said first side of said carrier means faces said first carton and said second side of said carrier means faces said second carton;

wherein said dual cigarette carton is dimensioned to contain twice the fourth number of cigarette packs, which is equal to said first number of cigarette packs.

2. The dual cigarette carton defined in claim 1 wherein one half of said carrier means bears adhesive only on said first side and the remaining half of said carrier means bears adhesive only on said second side.

3. The dual cigarette carton defined in claim 2 wherein said carrier means has a line of weakness along the border of said half with adhesive only on said first side and said half with adhesive only on said second side.

4. The dual cigarette carton defined in claim 3 wherein said line of weakness is constituted by a line of perforations.

5. The dual cigarette carton defined in claim 1 wherein said at least one carrier means includes a first carrier means whose first side is directly adhered to said interior front wall of said first carton and a second carrier means whose second side is directly adhered to said interior front wall of said second carton, and said second side of said first carrier means is releasably connected to said first side of said second carrier means.

6. The dual cigarette carton defined in claim 5 wherein said first side of said first carrier means and said second side of said second carrier means bear permanent adhesive for attachment to said first and second cartons, respectively; and said second side of said first carrier means and said first side of said second carrier means bear releasable, pressure-sensitive adhesive for attachment of said first and second carrier means to each other.

7. The dual cigarette carton defined in claim 6 wherein said releasable adhesive does not leave a tacky residue upon separation of said first and second cartons.

8. The dual cigarette carton defined in claim 1 further including at least one substantially flat carrier means and an adhesive borne on one side of said carrier means, wherein said carrier means bearing adhesive on one side is positioned above and across at least one pair of adjacent, coplanar, exterior walls with the adhesive-bearing side in operative contact with said last mentioned exterior walls.

9. The dual cigarette carton defined in claim 8 wherein said carrier means bearing adhesive on one side bears indicia encoded for automatic pricing of the dual cigarette carton and each of said interior front walls of said cartons bears indicia encoded for automatic pricing of an individual carton.

10. The dual cigarette carton defined in claim 9 wherein said indicia on said carrier means are bar code lines printed substantially parallel to the adjacent edges of the walls across which said carrier means is positioned, such that said indicia are rendered unreadable by automatic equipment when said carrier means is torn upon separating said cartons for sale of the individual cartons.

11. The dual cigarette carton defined in claim 1 wherein said first and second cartons are formed from separate substantially identical first and second halves of a single blank.

12. The dual cigarette carton defined in claim 11 wherein said single blank has a line of weakness dividing said single blank into said separate substantially identical first and second halves.

13. The dual cigarette carton defined in claim 12 wherein said line of weakness is constituted by a line of perforations.

14. The dual cigarette carton defined in claim 1 wherein said first and second cartons are formed from separate substantially identical blanks.

15. The dual carton defined in claim 1 wherein said second number of times the width of the long wall of said cigarette pack is five times.

16. The dual carton defined in claim 1 wherein said third number of times the width of the short wall of said cigarette pack is one.

17. A dual cigarette carton for packaging a first number of cigarette packs and of dimensions compatible with commercially available tax-stamping machinery used in the automated processing of cigarette cartons, each said cigarette pack having a pair of opposed long walls and a pair of opposed short walls, said dual cigarette carton comprising:

a first carton having four substantially vertical walls, an exterior top wall, and an exterior bottom wall; said four substantially vertical walls including an interior front wall, an exterior rear wall substantially parallel and spaced from said interior front wall, and first and second exterior side walls connecting juxtaposed vertical edges of said interior front wall and said exterior rear wall; wherein said exterior rear wall has an extension along the top edge thereof, said extension being folded substantially perpendicular to said exterior rear wall and extending towards said interior front wall, thereby forming said exterior top wall; the widths of said interior front wall and said exterior rear wall being sufficiently wider than a second number of times the width of the long wall of said cigarette pack, and the widths of said exterior side walls being sufficiently wider than a third number of times the width of the wall of said cigarette pack such that a fourth number of cigarette packs, equal to the product of said second number of times the width of the long wall of said cigarette pack and said third number of times the width of the short wall of said cigarette pack, can be positioned inside said first carton with said short walls parallel said side walls;

a second carton substantially identical to said first carton, said first and second cartons positioned adjacent one another with the interior front wall of said first carton coextensive with the interior front wall of said second carton such that the borders of the interior front walls are aligned; and at least one substantially flat carrier means having a first side and a second side, and an adhesive borne on one side of said carrier means, said carrier means bearing said adhesive being positioned across at least one pair of adjacent, coplanar, exterior walls of said first and second cartons with the adhesive-bearing side in operative contact with said last mentioned exterior walls to securely yet releasably connect said cartons in position adjacent one another such that the borders of the interior front walls are aligned;

wherein said dual cigarette carton is dimensioned to contain twice the fourth number of cigarette packs, which is equal to said first number of cigarette packs.

18. The dual cigarette carton of claim 17 wherein said carrier means has a line of weakness which can readily be severed to separate said first and second cartons.

19. The dual cigarette carton defined in claim 18 wherein said line of weakness is constituted by a line of perforation positioned above and parallel to the adjacent edges of the exterior walls across which said carrier means is positioned.

20. The dual cigarette carton defined in claim 17 wherein said adhesive is a permanent adhesive.

21. The dual cigarette carton defined in claim 17 wherein said adhesive is a releasable, pressure sensitive adhesive.

22. The dual cigarette carton defined in claim 17 wherein said at least one pair of adjacent, coplanar, exterior walls is at least one pair of adjacent, coplanar side walls.

23. The dual cigarette carton defined in claim 22 wherein said at least one pair of adjacent, coplanar side walls includes both pairs of adjacent, coplanar side walls.

24. The dual cigarette carton defined in claim 17 wherein said at least one pair of adjacent, coplanar walls includes said exterior bottom walls.

25. The dual cigarette carton defined in claim 24 wherein said at least one pair of adjacent, coplanar walls further includes at least one pair of adjacent, coplanar side walls.

26. The dual cigarette carton defined in claim 17 wherein said carrier means is positioned both across said exterior bottom walls and across a pair of adjacent, coplanar side walls.

27. The dual cigarette carton defined in claim 17 wherein said first and second cartons are formed from separate substantially identical first and second halves of a single blank.

28. The dual cigarette carton defined in claim 27 wherein said single blank has a line of weakness dividing said single blank into said separate substantially identical first and second halves.

29. The dual cigarette carton defined in claim 28 wherein said line of weakness is constituted by a line of perforations.

30. The dual cigarette carton defined in claim 17 wherein said first and second cartons are formed from separate substantially identical blanks.

31. The dual cigarette carton defined in claim 17 wherein said carrier means bears indicia encoded for automatic pricing of the dual cigarette carton.

32. The dual cigarette carton defined in claim 31 wherein each said interior front wall of said cartons bears indicia encoded for automatic pricing of an individual carton.

33. The dual cigarette carton defined in claim 31 wherein said indicia on said carrier means are bar code lines printed substantially parallel to the adjacent edges of the walls across which said carrier means is positioned such that said indicia are rendered unreadable by automatic equipment when said carrier means is torn upon separating said cartons for sale of the individual cartons.

34. The dual cigarette carton defined in claim 31 wherein said carrier means has a line of weakness positioned above and substantially parallel to the adjacent edges of the walls across which the carrier means is positioned.

35. The dual cigarette carton defined in claim 34 wherein said line of weakness is constituted by a line of perforations.

36. The dual cigarette carton defined in claim 17 wherein said second number of times the width of the long wall of said cigarette pack is five times.

37. The dual cigarette carton defined in claim 17 wherein said third number of times the width of the short wall of said cigarette pack is one.

38. A dual cigarette carton for packaging cigarette packs and of dimensions compatible with commercially available tax-stamping machinery used in the automated processing of cigarette cartons, each said cigarette pack having a pair of opposed long walls and a pair of opposed short walls, said dual cigarette carton comprising:

a first carton having four substantially vertical walls, an exterior top wall, and an exterior bottom wall; said four substantially vertical walls including an interior front wall, an exterior rear wall substantially parallel and spaced from said interior front wall, and first and second exterior side walls connecting juxtaposed vertical edges of said interior front wall and said exterior rear wall; wherein said exterior rear wall has a first extension along the top edge thereof, said extension being folded substantially perpendicular to said exterior rear wall and extending towards said interior front wall to cover the top of said carton, thereby forming said exterior top wall; the widths of said interior front wall and exterior rear wall being sufficiently wider than a second number of times the width of the long wall of said cigarette pack, and the widths of said exterior side walls being sufficiently wider than a third number of times the width of the short wall of said cigarette pack such that a fourth number of cigarette packs, equal to the product of said second number of times the width of the long wall of said cigarette pack and said third number of times the width of the short wall of said cigarette pack, can be positioned inside said first carton with said short walls parallel said side walls;

a second carton identical to said first carton, said first and second cartons positioned adjacent one another with the interior front wall of said first carton completely adjacent the interior front wall of said second carton such that the borders of the interior front walls are aligned; and at least one substantially flat carrier means having a first side and a second side, and an adhesive borne on at least part of at least one side of said carrier means, said carrier means bearing said adhesive being positioned across at least two adjacent walls of said cartons with said adhesive in operative contact with said at least two adjacent walls to securely yet releasably connect said cartons in position adjacent one another;

wherein said dual cigarette carton is dimensioned to contain twice the fourth number of cigarette packs, which is equal to said first number of cigarette packs.

39. The dual cigarette carton defined in claim 38 wherein said carrier means is positioned between said interior front walls of said first and second cartons, whereby said first side of said carrier means faces said first carton and said second side of said carrier means faces said second carton; wherein one half of said carrier means bears adhesive only on said first side and the remaining half of said carrier means bears adhesive only on said second side.

40. The dual cigarette carton defined in claim 39 wherein said carrier means has a line of weakness along the border of said half with adhesive only on said first side and said half with adhesive only on said second side.

41. The dual cigarette carton of claim 40 wherein said line of weakness is constituted by a line of perforations.

42. The dual cigarette carton defined in claim 38 wherein said at least one carrier means includes a first carrier means whose first side is directly adhered to said interior front wall of said first carton and a second carrier means whose second side is directly adhered to said interior front wall of said second carton, and said second side of said first carrier means is releasably connected to said first side of said second carrier means.

43. The dual cigarette carton defined in claim 42 wherein said first side of said first carrier means and said second side of said second carrier means bear permanent adhesive for attachment to said first and second cartons, respectively; and said second side of said first carrier means and said first side of second carrier means bear releasable, pressure-sensitive adhesive for attachment of said first and second carrier means to each other.

44. The dual cigarette carton defined in claim 43 wherein said releasable adhesive does not leave a tacky residue upon separation of said first and second cartons.

45. The dual cigarette carton defined in claim 38 wherein said carrier means bearing said adhesive is positioned across at least two adjacent coplanar exterior walls of said first and second cartons.

46. The dual cigarette carton defined in claim 45 wherein said carrier means has a line of weakness positioned above and substantially parallel to the adjacent edges of the exterior walls across which said carrier means is positioned.

47. The dual cigarette carton defined in claim 46 wherein said line of weakness is constituted by a line of perforations.

48. The dual cigarette carton defined in claim 45 wherein said adhesive is a permanent adhesive.

49. The dual cigarette carton defined in claim 45 wherein said adhesive is a releasable, pressure-sensitive adhesive.

50. The dual cigarette carton defined in claim 38 wherein each of said first and second carton further includes a second extension along the end of said first extension, each said second extension being folded to be substantially parallel said interior front walls when said first extensions are folded across the top of said carton.

51. The dual cigarette carton defined in claim 38 wherein said first and second cartons are formed from separate substantially identical first and second halves of a single blank.

52. The dual cigarette carton defined in claim 51 wherein said single blank has a line of weakness dividing said single blank into said separate substantially identical first and second halves.

53. The dual cigarette carton defined in claim 52 wherein said line of weakness is constituted by a perforated line.

54. The dual cigarette carton defined in claim 38 wherein said first and second cartons are formed from separate substantially identical blanks.

55. The dual cigarette carton defined in claim 38 wherein said second number of times the width of the long wall of said cigarette pack is five times.

56. The dual cigarette carton defined in claim 38 wherein said third number of times the width of the short wall of said cigarette pack is one.

* * * * *